US009143847B2

(12) United States Patent
Dodd

(10) Patent No.: US 9,143,847 B2
(45) Date of Patent: Sep. 22, 2015

(54) LOUDSPEAKER

(75) Inventor: Mark Alexander Dodd, Suffolk (GB)

(73) Assignee: GP ACOUSTICS (UK) LIMITED, Maidstone (GB)

( * ) Notice: Subject to any disclaimer, the term of this patent is extended or adjusted under 35 U.S.C. 154(b) by 0 days.

(21) Appl. No.: 14/002,930

(22) PCT Filed: Mar. 2, 2012

(86) PCT No.: PCT/GB2012/000218

§ 371 (c)(1),
(2), (4) Date: Sep. 3, 2013

(87) PCT Pub. No.: WO2012/117229

PCT Pub. Date: Sep. 7, 2012

(65) Prior Publication Data

US 2013/0333975 A1 Dec. 19, 2013

(30) Foreign Application Priority Data

Mar. 2, 2011 (GB) ..... 1103525.0

(51) Int. Cl.
*H04R 1/28* (2006.01)
*H04R 1/02* (2006.01)

(52) U.S. Cl.
CPC ..... *H04R 1/021* (2013.01); *H04R 1/2826* (2013.01)

(58) Field of Classification Search
CPC ..... H04R 1/2819; H04R 1/2826
USPC ..... 181/156; 381/388, 349
See application file for complete search history.

(56) References Cited

U.S. PATENT DOCUMENTS

| | | | | |
|---|---|---|---|---|
| 3,393,764 | A | 7/1968 | Schafer | |
| 4,783,820 | A | 11/1988 | Lyngdorf et al. | |
| 5,012,890 | A | 5/1991 | Nagi | |
| 5,109,422 | A * | 4/1992 | Furukawa | 381/96 |
| 5,150,417 | A * | 9/1992 | Stahl | 381/349 |
| 5,571,242 | A | 11/1996 | Demorest | |
| 6,275,597 | B1 * | 8/2001 | Roozen et al. | 381/345 |

FOREIGN PATENT DOCUMENTS

| | | | |
|---|---|---|---|
| EP | 0361445 | A2 | 4/1990 |
| EP | 0459682 | A2 | 12/1991 |
| EP | 0917396 | A2 | 5/1999 |
| EP | 1162864 | A2 | 12/2001 |
| EP | 1370110 | A1 | 12/2003 |
| GB | 2318475 | A | 4/1998 |
| WO | 9962292 | A1 | 12/1999 |
| WO | 03034778 | A2 | 4/2003 |

OTHER PUBLICATIONS

GB Search Report; GB1108333.4; Jun. 7, 2011.
International Search Report and Written Opinion; PCT/GB2012/000218; Jun. 15, 2012.

* cited by examiner

*Primary Examiner* — Jeremy Luks
(74) *Attorney, Agent, or Firm* — Westman, Champlin & Koehler, P.A.; Z. Peter Sawicki

(57) ABSTRACT

The present invention provides a loudspeaker with a port tube having an acoustic leakage path through a motile part thereof. In this way, excess energy caused by longitudinal resonance at higher frequencies is radiated transversely through the port tube walls rather than contributing to the output of the loudspeaker itself.

16 Claims, 5 Drawing Sheets

LOUDSPEAKER

CROSS REFERENCE TO RELATED APPLICATION

This Application is a Section 371 National Stage Application of International Application No. PCT/GB2012/000218, filed Mar. 2, 2012, and published as WO 2012/117229 on Sep. 7, 2012, in English, which claims priority to and benefits of British Patent Application No. GB1103525.0, filed Mar. 2, 2011, the contents of which are hereby incorporated by reference in their entirety.

FIELD OF THE INVENTION

The present invention relates to loudspeakers, and particularly to loudspeakers having a port or vent, such as 'reflex' or 'coupled cavity' loudspeakers.

BACKGROUND ART

A reflex loudspeaker enclosure is one in which the rear of a loudspeaker diaphragm radiates into an enclosed air volume, with a duct known as a 'port tube' connecting this air volume to free space.

The port tube and the enclosed volume combine to behave as a Helmholtz resonator which, when driven by the rear of the loudspeaker diaphragm, results in a fourth order high pass response at low frequencies. This system provides greater low frequency output in the region of the port tuning frequency.

The alignment of this type of loudspeaker has been well documented by Neville Thiele (see for example Thiele, A. N., "Loudspeakers in Vented Boxes, Parts I and II", *J. Audio Eng. Soc.*, vol. 19, pp. 382-392 (May 1971); pp. 471-483 (June 1971)) and Richard Small (see for example "Vented-Box Loudspeaker Systems", *J. Audio Eng. Soc.*, vol. 21, pp. 363-372 (June 1973); pp. 438-444 (July/August 1973); pp. 549-554 (September 1973); pp. 635-639 (October 1973)).

The tuning frequency of the port is given by the well known equation derived for a Helmholtz resonator. That is, $$f_H = \frac{v}{2\pi}\sqrt{\frac{A}{V_0 L}}, \tag{1}$$

where $f_H$ is the Helmholtz resonant frequency, v is the speed of sound through the atmosphere, A is the cross-sectional area of the port, $V_0$ is the static volume of the port and L is the length of the port. A particular tuning frequency may be achieved therefore with a short port of small area or a longer port of correspondingly larger area.

However, the sound pressure within the box results in waves travelling down the port. These are reflected by the large change of acoustic impedance at the ends of the tube, resulting in longitudinal resonances similar to those found in organ tubes and many other musical instruments. These resonances produce undesirable peaks in the acoustic output of the port which distort the tonal purity of the loudspeaker. In some cases visible anomalies are produced in the frequency response of the loudspeaker. This effect is extremely undesirable in a high quality loudspeaker.

In practice, air flow in the port is also a significant issue since at high velocities turbulence may occur (A. Salvatti, A. Devantier and D. J. Button, "Maximizing Performance from Loudspeaker Ports," J. Audio Eng. Soc, vol. 50, no. 1/2, pp. 19-45, 2002.). Turbulence causes distortion and loss of output so is best avoided at working levels.

FIG. 1 shows the calculated frequency responses of a driven diaphragm, a reflex port, and their combination in a conventional reflex loudspeaker. The goal of high-performance loudspeakers is to achieve as smooth and even a response as possible across the range of working frequencies of the device. It can be seen that, on its own, the diaphragm displays a response which is both smooth and at a good level at higher frequencies but drops off markedly at lower frequencies. The reflex port is designed to counteract this low-frequency drop off, and provides a relatively high response at low frequencies (corresponding to Helmholtz resonance) and a low response at high frequencies. Thus, their combination leads to a response that is more extended at low frequencies than for the diaphragm alone.

However, the reflex port also exhibits a number of sharp peaks in its response at high frequencies, corresponding to the longitudinal-mode resonances described above. This in turn leads to peaks in the response of the loudspeaker as a whole and undesirable distortion of the projected sound.

SUMMARY OF THE INVENTION

The problem is how to damp these longitudinal resonances without damping the Helmholtz resonance, altering the tuned Helmholtz frequency significantly or exacerbating turbulence. For example, one approach might be to place acoustically absorbent material in the port tube to damp the longitudinal resonance. However, this also has a large damping effect on the Helmholtz resonance and exacerbates turbulent flow at high levels.

The present invention seeks to overcome these problems by providing a loudspeaker with a port tube having a section within it that provides an acoustic leakage path. This can provide the necessary damping of longitudinal resonances, but can be constructed in a way that does not encourage turbulence.

In one embodiment the present invention provides a loudspeaker, comprising an enclosure, an acoustically radiating diaphragm, and a port conduit (which will usually be in the form of a tube) acoustically coupling the interior of the enclosure to a region external thereto, wherein the port conduit comprises a rigid conduit segment, coupled to a flexible conduit segment providing an acoustic leakage path in a direction transverse to a longitudinal axis of the port conduit.

Some benefit can be obtained if, at the relatively high frequencies corresponding to longitudinal resonances, the flexible conduit segment has a relatively low acoustic impedance as compared to its acoustic impedance at the lower Helmholtz resonant frequency. Excess energy caused by the longitudinal resonances is radiated transversely, reducing the magnitude of the longitudinal resonances and their contribution to the output of the loudspeaker. At relatively low frequencies corresponding to Helmholtz resonance, the acoustic impedance of the port tube wall is then relatively high compared to the ends of the tube, so the Helmholtz resonance is largely unaffected and the port tube still provides an important contribution to the loudspeaker output at frequencies where the response of the diaphragm is poor.

However, we have noticed that the pressure differential between the air within the port tube and the air immediately outside the port tube (i.e. within the remainder of the loudspeaker cabinet) is very much larger for longitudinal resonances as opposed to Helmholtz resonances. This means that, even if the acoustic impedance of the flexible conduit segment is the same at both frequencies, there will be a greater absolute effect on the longitudinal resonances than on the Helmholtz resonances.

In order to reduce the turbulence which might distort the loudspeaker output, an internal surface of the port tube is smooth at least in a direction parallel to its longitudinal axis, or even in all directions. This particularly applies to the connection(s) between rigid and flexible segments, where turbulence is likely if there is a discontinuity. Smooth connections will reduce turbulent flow and improve the loudspeaker output. The flexible conduit segment will also usually be impermeable.

The acoustic leakage path may be provided along a part of the port tube's length, or substantially all of the port tube's length such that the rigid segment(s) provide only a collar at one or both ends. The collar may be flared in order to further discourage turbulence. In an embodiment, the leakage path is located so as to include a pressure anti-node of the longitudinal resonances (for example, the first-order longitudinal resonance and possible the second-order longitudinal resonance), causing the greatest damping for those orders of resonance.

In order to provide the necessary acoustic leakage path, the motile part of the port tube may comprise a membrane, having a thickness in a range with an upper limit selected from the group 4 mm, 2 mm, 1 mm and 0.5 mm, and a lower limit of 0.025 mm. Alternatively, a very low modulus material such as a foamed material (preferably closed cell) can be used; this will allow a thicker wall to be provided which has the advantage that it may be self-supporting. The ring frequency of the tube may be tuned by selecting an appropriate material and/or thickness to coincide with the longitudinal resonant frequencies (for example the first-order resonant frequency). Alternatively, a rigid port diaphragm can be provided, coupled to the port tube via flexible joints to allow the necessary leakage path.

In a further embodiment, the port tube may comprise corrugations running parallel to said longitudinal axis, with the number and/or depth of the corrugations being selectable to achieve a ring frequency coinciding with the longitudinal resonant frequencies. These can further assist the self-supporting nature of the conduit, and (importantly) do not create turbulence as a result of being aligned parallel to the longitudinal axis.

In a still further embodiment, the port tube may comprise a plurality of rigid elongate segments coupled to each other by flexing joints. A closed cell foam suspension may be suitable to achieve the necessary acoustic leakage while providing an air seal. The number of segments may be selectable to achieve the desired ring frequency.

The acoustic leakage path typically has a relatively low acoustic impedance at a first frequency value, and a relatively high acoustic impedance at a second, lower, frequency value. This allows longitudinal resonances to be dispersed while containing Helmholtz resonances.

The radiating diaphragm can be arranged in the loudspeaker such that, when driven, a front side thereof radiates acoustically to the atmosphere outside the enclosure, and a back side radiates acoustically into an interior of the enclosure—i.e. a bass reflex loudspeaker. In such a context, the port conduit will usually have dimensions so as to achieve a Helmholtz resonant frequency at the first, relatively low frequency value and longitudinal resonant frequencies at the second, relatively high frequency value.

In addition, however, the invention is applicable to a more general loudspeaker enclosure where the primary function of the port is as part of an acoustic filter system, such as a coupled cavity and reflex or transmission line loudspeaker. Thus, the primary function of the port may be as an acoustic mass as part of an acoustic filter system.

BRIEF DESCRIPTION OF THE DRAWINGS

An embodiment of the present invention will now be described by way of example, with reference to the accompanying figures in which.

DETAILED DESCRIPTION OF THE EMBODIMENTS

Figure 2:
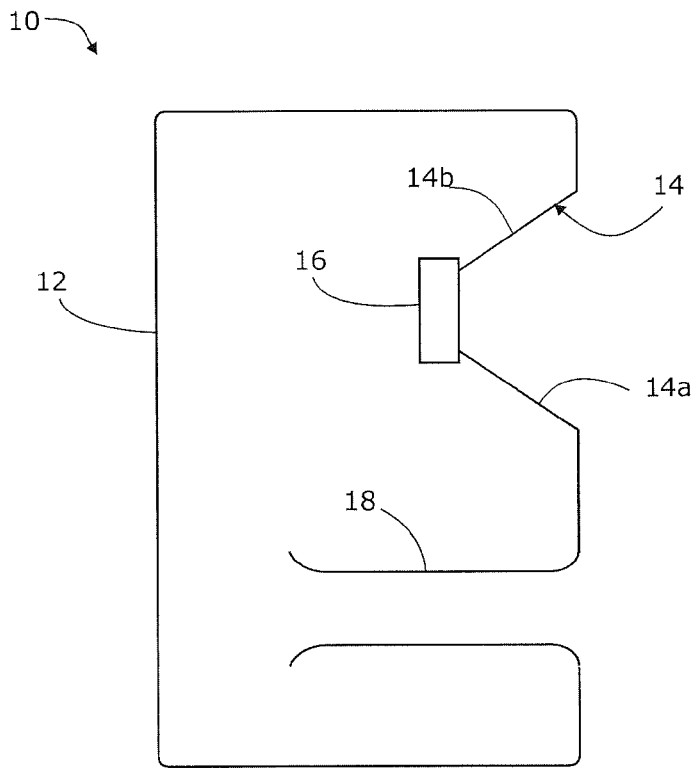
FIG. 2 is a schematic drawing of a reflex loudspeaker.

FIG. 2 is a schematic diagram showing a reflex loudspeaker 10 in which embodiments of the present invention may be employed. The loudspeaker 10 comprises a cabinet (also called a box, or enclosure) 12, a diaphragm 14 mounted in the cabinet and a drive unit 16 for driving the diaphragm 14 to radiate acoustic waves. A front side 14*a* of the diaphragm radiates acoustically to the atmosphere, i.e. projects acoustic waves outwards from the loudspeaker. A rear side 14*b* of the diaphragm radiates inwardly, towards the internal volume of the cabinet.

A port tube 18 is also located in the cabinet, and comprises an open-ended elongate tubular structure extending from an aperture in the cabinet. The port tube acoustically couples the cabinet's interior to its exterior, and provides a performance boost at lower frequencies. Although in the illustrated embodiment the port tube extends inwardly, into the interior of the cabinet, it will be apparent from the description below that at least part of the tube may lie outside the cabinet, or in a separate enclosed volume.

In use, the port tube 18 acts as a Helmholtz resonator with a Helmholtz resonant frequency given by equation (1) above. The dimensions (i.e. cross-sectional area, volume and length) of the tube 18 can thus be chosen in order to achieve a particular Helmholtz frequency and thus provide a performance boost in a particular part of the spectrum. That is, the port tube is "tuned". Usually, this is at a low frequency where the diaphragm response alone is inadequate.

However, the port tube 18 also gives rise to unwanted longitudinal resonances at higher frequencies, and can experience turbulence which further distorts the speaker output.

In order to suppress these unwanted resonances, the port tube according to embodiments of the present invention comprises an acoustic leakage path through a motile part thereof, with frequency-dependent acoustic impedance. At relatively low frequencies (i.e. those corresponding to the Helmholtz resonance) the acoustic impedance of the leakage path is relatively high; at relatively high frequencies (i.e. those corresponding to the unwanted longitudinal frequencies) the acoustic impedance of the leakage path is relatively low. This relatively low impedance allows the longitudinal vibrations to transmit energy transverse to the longitudinal axis of the port tube, i.e. out through the walls of the port tube. If the port tube lies entirely within the enclosed volume of the cabinet 12, this energy is radiated back into that volume. It will also be apparent to those skilled in the art that the port tube can lie outside the enclosed volume or in a separate enclosed volume, in which case the energy is radiated correspondingly. In either case, however, the acoustic leakage provides a material drop in the output of the port at the higher frequencies of the longitudinal resonances.

The acoustic leakage path can be provided in just part of the port tube 18 (in which case the port tube will in general comprise one or more motile parts connected via rigid parts) or along substantially its entire length (in which case the entire port tube may be motile, although it may comprise rigid end caps). The latter provides the greatest reduction in resonance, but the former also reduces the resonant behaviour of the port tube. If the leakage path is provided in just part of the port tube, there are advantages in placing it to coincide with a pressure anti-node of the longitudinal resonances. For example, the leakage path may be placed approximately half-way down the port tube, to coincide with the pressure anti-node of the first-order resonance. The leakage path may be extended (or further leakage paths provided) to coincide with anti-nodes of second-order resonance, i.e. a quarter or three quarters of the way along the tube's length.

In one embodiment of the present invention, and as will be described in more detail below, the acoustic leakage path is provided by a thin tubular membrane (i.e. the motile part is a membrane). The membrane may have a thickness in a range with an upper limit selected from the group 4 mm, 2 mm, 1 mm and 0.5 mm, and a lower limit of 0.025 mm. It may be manufactured from rubber (synthetic or natural) or another suitable lightweight material, using dip moulding, compression moulding or other suitable techniques. An alternative is to employ a material with a lower modulus, such as a foamed material, preferably closed-cell. These or other low density materials allow for a somewhat thicker wall to be provided.

In either case, the entire port tube 18 or just part thereof can be made from such materials, for example with the motile parts provided in one or more openings in an otherwise rigid structure. In practice, this could be achieved by providing a rigid port wall and either motile membranes forming a deformable seal over the openings in the port walls, or rigid diaphragms supported in the openings by flexible joints. Those openings could be longitudinal along the port, or otherwise as desired in order to tailor the properties of the port walls. This could provide a particularly practical and inexpensive form of construction.

In an alternative embodiment, the port tube 18 comprises a plurality of substantially rigid elongate segments lying parallel to the longitudinal axis of the tube. Each segment is connected to its neighbour by a flexing join, giving a degree of flexibility to the port tube as a whole. Of course, alternative approaches may be designed by those skilled in the art without departing from the scope of the invention as defined in the claims below.

Figure 3:
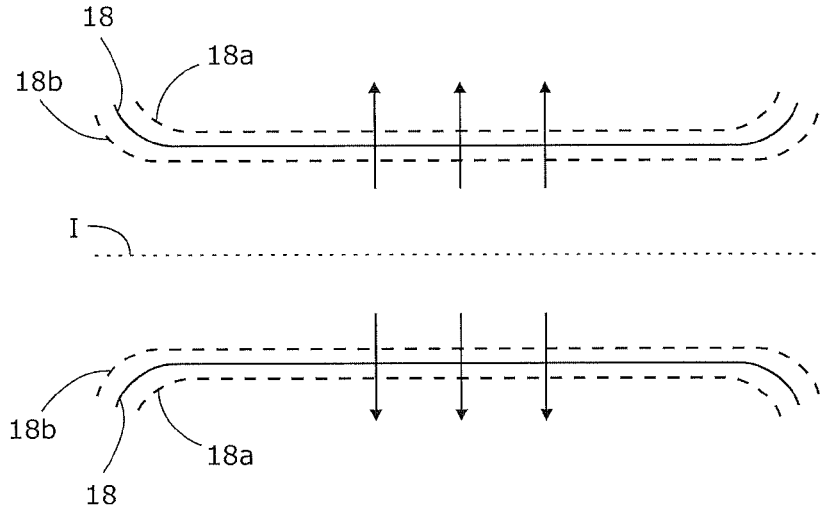
FIG. 3 is a schematic drawing of a reflex port according to embodiments of the present invention, undergoing resonance.

FIG. 3 is a schematic diagram showing the mechanical resonance of the port tube according to embodiments of the present invention. The longitudinal axis is indicated by the reference numeral I.

It can be seen that, at the relatively high frequencies corresponding to longitudinal resonances, the port tube 18 is constructed from a material so as to allow expansion and contraction in a direction transverse to the longitudinal axis. The expanded port tube is indicated by the dashed lines and reference 18*a*; the contracted port tube is indicated by the dashed lines and reference 18*b*. This motion at higher frequencies allows energy to be radiated away from the port tube in the transverse direction shown. At lower frequencies, the port tube has higher acoustic impedance and thus does not move a significant amount in this way.

Figure 4:
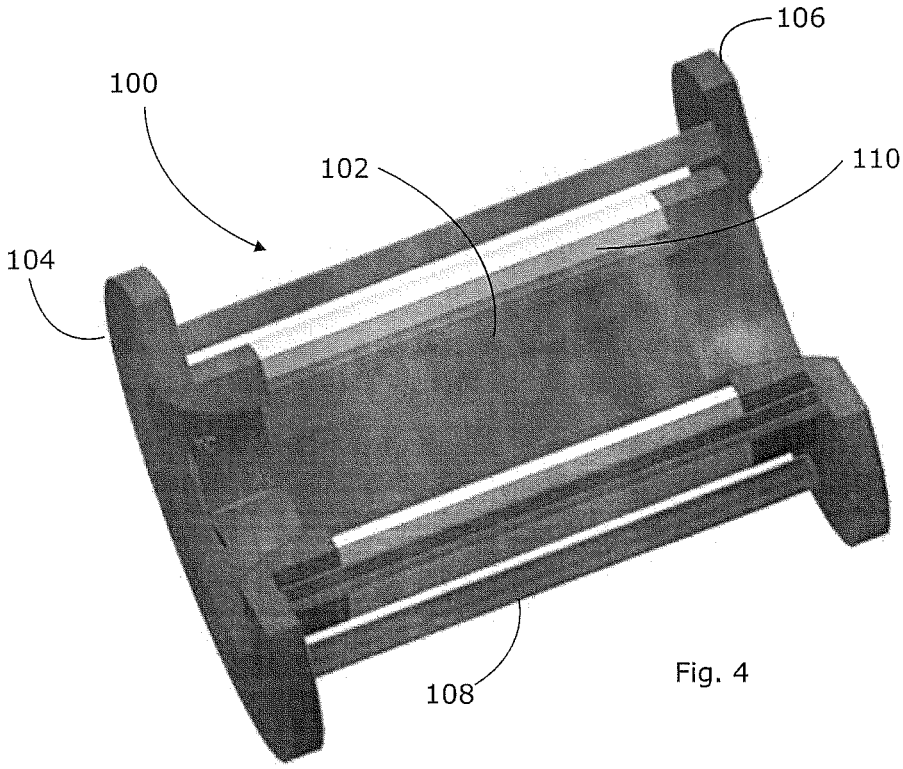
FIG. 4 shows a reflex port according to an embodiment of the present invention.

FIG. 4 shows an embodiment of the port tube in more detail. The port tube is denoted with a reference numeral 100, although it will be apparent that it can replace the port tube 18 in the loudspeaker shown in FIG. 2.

The port tube 100 comprises a thin tubular membrane 102 which extends between rigid annular support structures 104, 106 at its respective ends. These also provide a flared end to the conduit defined by the port tube 100, to help minimise turbulence. The membrane itself has a completely smooth internal surface, and thus defines a regular cylinder held open by the support structures 104, 106. By ensuring a smooth internal surface (i.e. one without gaps, ridges or other sharp changes of direction), turbulent air flow can be minimized. The connections between the membrane 102 and the support structures 104, 106 are likewise kept smooth, i.e. presenting a substantially constant internal diameter, to minimise turbulence.

A plurality of rigid struts 108 run parallel to the longitudinal axis of the tube 100, outside the membrane 102 and extending between the support structures 104, 106. In general, one of the support structures 104 will be connected to an aperture in the cabinet 12. The other support structure 106 may be left unsupported within the enclosed volume of the cabinet 12. The struts 108 therefore brace the membrane 102 and maintain its cylindrical shape. The need for struts will be dependent on the choice of material and its thickness; some materials such as a closed-cell foam of approximately 3 mm thickness will be sufficiently self-supporting that they do not need struts, others will require struts such that the structure as a whole is both self-supporting and has the necessary acoustic properties as set out herein.

The membrane 102 may have a thickness in a range with an upper limit selected from the group 4 mm, 2 mm, 1 mm and 0.5 mm, and a lower limit of 0.025 mm. It may be manufactured from closed-cell foam, or rubber (synthetic or natural), or another suitable lightweight material, using dip moulding, compression moulding or other suitable techniques. By careful selection of the membrane material and thickness, the port tube ring frequency can be tuned to match the frequency of the longitudinal resonance (for example, the first-order resonance).

FIG. 4 also shows an optional cylinder of permeable material 110, positioned concentrically with and running outside the membrane 102. The permeable material provides additional resistive losses. To avoid this resistance being short circuited, however, the ends of the permeable cylinder 110 are sealed to the support structures 104, 106. Provision of the permeable cylinder can assist when less lossy membranes are employed.

Figure 5:
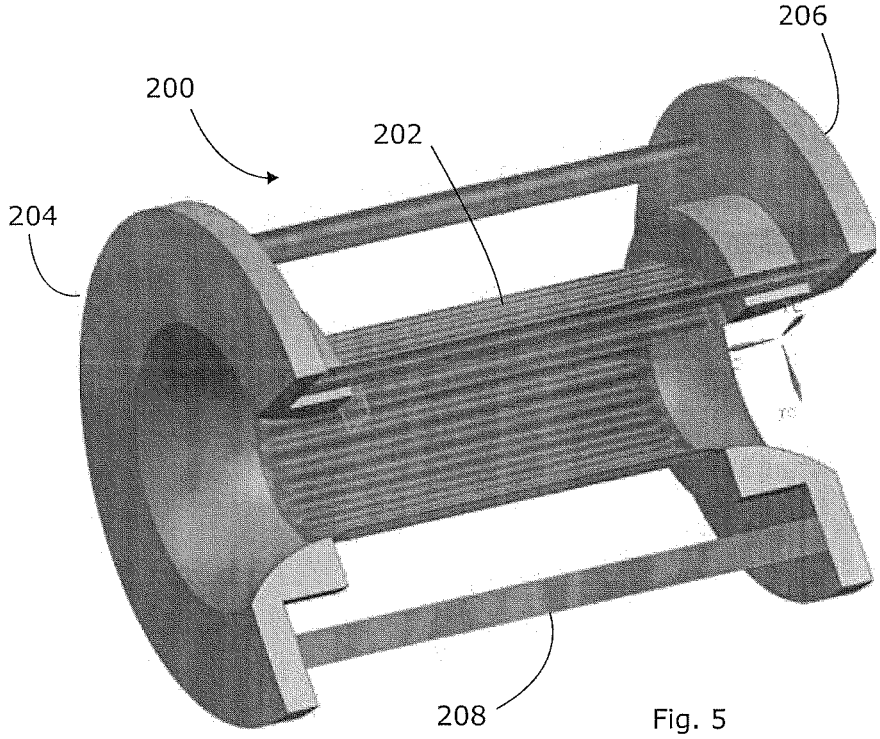
FIG. 5 shows a reflex port according to another embodiment of the present invention.

FIG. 5 shows a port tube 200 according to a further embodiment of the present invention.

Again, the port tube comprises a thin tubular membrane 202 extending between rigid support structures 204, 206. Struts 208 also extend between the support structures to lend the port tube 200 the necessary rigidity in case one of the structures 204, 206 is not connected to a rigid part of the cabinet 12.

In this embodiment, the membrane 202 comprises a number of corrugations running parallel to the longitudinal axis of the port tube 200. The number and/or depth of the corrugations can be adapted in order to select a particular ring frequency, and thus tune the port tube to radiate energy transversely at frequency values corresponding to the longitudinal resonances.

Although not defining a completely smooth internal surface, the corrugated membrane 202 does have a smooth surface in a direction parallel to the longitudinal axis (and thus parallel to air flow). Turbulence is again reduced compared to non-smooth internal surfaces. Although none is illustrated, it will be apparent to those skilled in the art that a cylinder of permeable material similar to that shown in FIG. 4 may also be provided in this embodiment.

Figure 6:
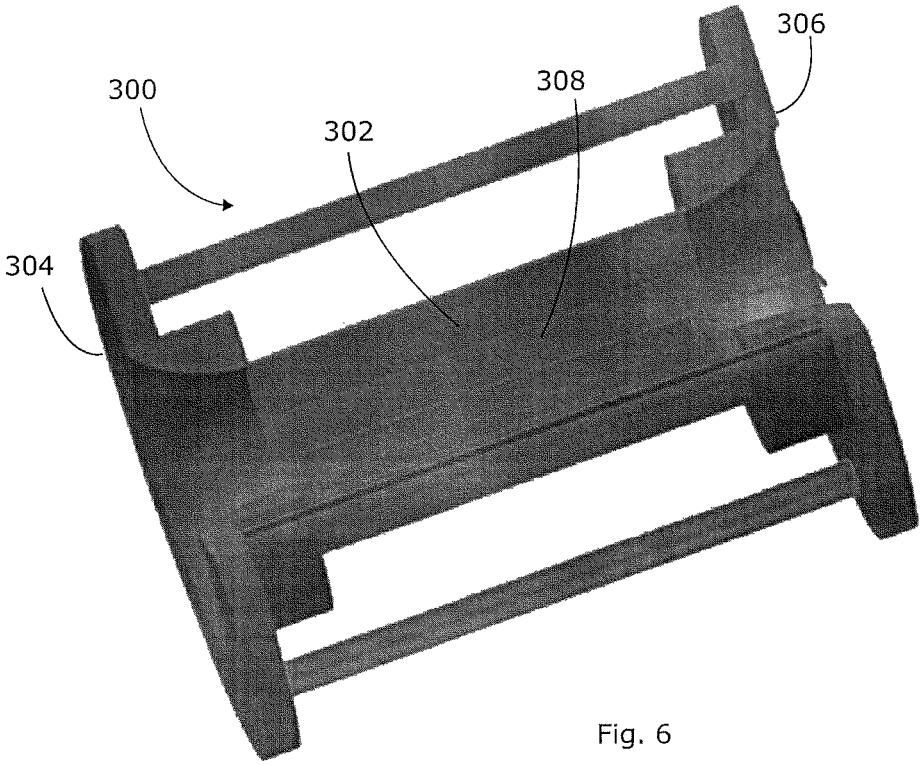
FIG. 6 shows a reflex port according to a further embodiment of the present invention.

FIG. 6 shows a port tube 300 according to a yet further embodiment. Again, the port tube 300 is suitable for use in a loudspeaker as shown in FIG. 2.

The port tube 300 has a similar construction to those described previously. In this embodiment, however, the tube itself is provided by a plurality of substantially rigid elongate segments 302 running parallel to the longitudinal axis of the tube 300. Each rigid segment 302 is coupled to its respective neighbours by flexible joints 308. The joints allow the segments to move, while providing an air seal. For example, a closed cell foam suspension could link each segment to its neighbours, and to the support structures 304, 306.

Again, resistive losses are provided by material losses in the suspension 308; however, if necessary an additional concentric cylinder of permeable material can be provided surrounding the tube 300 (as shown in FIG. 4).

Figure 7:
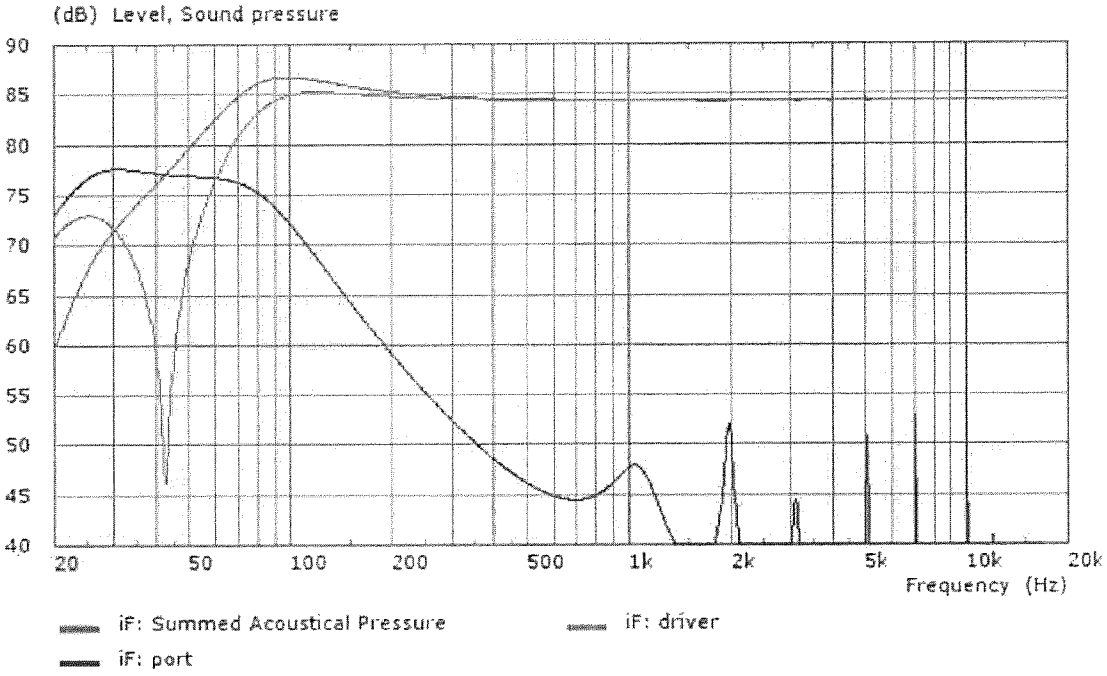
FIG. 7 is a graph showing the calculated response of a diaphragm, a reflex port according to embodiments of the present invention, and their combination in a loudspeaker.

FIG. 7 is a graph showing the calculated response of a diaphragm, a reflex port according to embodiments of the present invention, and their combination in a loudspeaker, representing a general port tube with an acoustic leakage.

Figure 1:
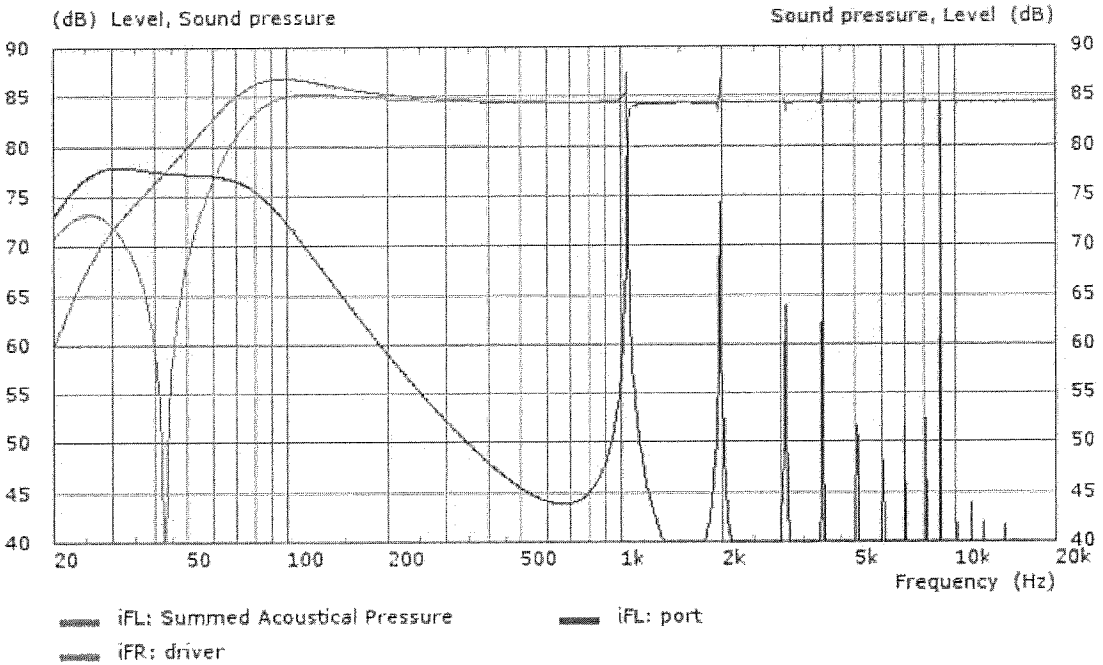
FIG. 1 is a graph showing the calculated response of a diaphragm, a reflex port and their combination in a conventional reflex loudspeaker.

In comparison to FIG. 1, it can be seen that the longitudinal resonances of the port tube at higher frequencies are significantly dampened, but that the lower-frequency Helmholtz resonance is neither dampened nor shifted to a different value. The performance of the loudspeaker at higher frequencies is markedly improved.

The present invention therefore provides a loudspeaker with a port tube having an acoustic leakage path through a motile part thereof which is frequency-dependent. At relatively low frequencies (corresponding to Helmholtz resonance), the leakage path has a relatively high acoustic impedance; at relatively high frequencies (corresponding to longitudinal resonances), the leakage path has a relatively low acoustic impedance. In this way, excess energy caused by longitudinal resonance at higher frequencies is radiated transversely through the port tube walls rather than contributing to the output of the loudspeaker itself.

It will of course be understood that many variations may be made to the above-described embodiment without departing from the scope of the present invention.

The invention claimed is:

1. A loudspeaker, comprising:

an enclosure defining an interior space and an exterior space;

an acoustically radiating diaphragm, and a port conduit, acoustically coupling the interior space to the exterior space, and having an internal surface which is smooth at least in a direction parallel to said longitudinal axis, wherein the port conduit comprises at least one rigid conduit segment, coupled to a flexible conduit segment to form one or more motile parts in one or more openings in an otherwise rigid structure, the flexible conduit segment providing an acoustic leakage path in a direction transverse to a longitudinal axis of the port conduit the flexible conduit segment being impermeable and having a completely smooth inner surface.

2. The loudspeaker according to claim 1, where the internal surface of said port conduit is smooth in all directions.

3. The loudspeaker according to claim 1, wherein said acoustic leakage path is located so as to include a pressure anti-node of longitudinal resonances of the port conduit.

4. The loudspeaker according to claim 1, wherein the acoustic leakage path extends along substantially the length of the port conduit.

5. The loudspeaker according to claim 1, wherein the flexible conduit segment comprises a deformable membrane.

6. The loudspeaker according to claim 5, where the membrane has a thickness of between 0.025 mm and 4 mm.

7. The loudspeaker according to claim 5, where the membrane has a thickness of between 1 mm and 3 mm.

8. The loudspeaker according to claim 1, wherein the port conduit comprises a plurality of rigid segments coupled to each other by flexible joints.

9. The loudspeaker according to claim 1, wherein the flexible conduit segments comprise closed cell foam.

10. The loudspeaker according to claim 1, further comprising one or more rigid support members extending from one end of the port conduit to the other.

11. The loudspeaker according to claim 1, wherein said acoustic leakage path further comprises a porous member lying outside a motile part of the port conduit.

12. The loudspeaker according to claim 1, comprising two rigid conduit segments either side of the flexible conduit segment.

13. The loudspeaker according to claim 12 wherein at least one of the rigid conduit segments defines a flared end to the conduit.

14. The loudspeaker according to claim 1, wherein the radiating diaphragm is arranged in the loudspeaker such that, when driven, a front side thereof radiates acoustically to the atmosphere outside the enclosure, and a back side radiates acoustically into an interior of the enclosure.

15. The loudspeaker according to claim 14, wherein the port conduit has dimensions so as to achieve a Helmholtz resonant frequency at a first, relatively low frequency value and longitudinal resonant frequencies at a second, relatively high frequency value.

16. The loudspeaker according to claim 1, wherein the acoustic leakage path has a relatively low acoustic impedance at a first frequency value, and a relatively high acoustic impedance at a second, lower, frequency value.

* * * * *